United States Patent [19]

Lindberg, Jr.

[11] Patent Number: 4,552,245

[45] Date of Patent: Nov. 12, 1985

[54] SWIMMING POOL LADDER SECUREMENT DEVICE

[76] Inventor: Albert W. Lindberg, Jr., 125 W. 6th St., Bayonne, N.J. 07002

[21] Appl. No.: 650,175

[22] Filed: Sep. 13, 1984

[51] Int. Cl.[4] ..... E06C 9/08

[52] U.S. Cl. ..... 182/97; 182/87

[58] Field of Search ..... 182/97, 228, 87; 403/374

[56] References Cited

U.S. PATENT DOCUMENTS 3,973,646 8/1976 Martinez ..... 182/97

FOREIGN PATENT DOCUMENTS 668859 3/1952 United Kingdom ..... 403/374

*Primary Examiner*—Reinaldo P. Machado

*Attorney, Agent, or Firm*—Collard, Roe & Galgano

[57] ABSTRACT

There is provided a securement device for a swimming pool ladder having tubular ladder rails which are hingedly connected to anchors mounted in the swimming pool deck which permits quick detachment and reattachment of the swimming pool ladder to the anchors. Each securement device includes a ferrule capping the end of the tubular ladder rail adjacent the pool deck which is hingedly connected to the respective anchor in the pool deck, an expandable locking mechanism coupled to the ferrule and extending into the tubular ladder rail which expands into locking engagement with the inside wall of the tubular ladder rail and which is expanded and relaxed by a device associated with the ferrule.

4 Claims, 4 Drawing Figures

SWIMMING POOL LADDER SECUREMENT DEVICE

The present invention relates to a detachable swimming pool ladder and, more particularly, it relates to a swimming pool ladder securement device which permits easy and quick detachment of the ladder from the securement device and thus from the swimming pool.

Specialized ladders are necessary in swimming pools in order to permit easy ingress and egress from the pool for swimmers and bathers. However, such ladders, since they are positioned along the peripheral edges of the pool, are a hindrance during swimming meets or races. The races during swimming meets are commenced by the participants executing a racing dive into designated racing lanes from the peripheral edge of the pool. If a pool ladder is so positioned along the peripheral edge of the pool to interfere with such a dive, then the corresponding swimming or racing lane cannot be used. In order to avoid such a situation, pool ladders are often positioned along the perimeter of a pool outside of the racing areas thereby limiting their availability to bathers who utilize the pool other than during racing events. Otherwise, it is necessary to unbolt the ladders from the pool deck and wall in order to accommodate each racing event. If this latter course is followed, a great deal of time and effort must be expended by the pool maintenance personnel in order to accommodate each racing event.

Many pool ladders in use today utilize a hinged securement to the pool deck which permits the ladder to be pivoted out of the pool. With such a hinged construction, the bottom ends of the ladder rails are not fastened to the pool side wall thereby permitting the upward swinging movement of the ladder. Such hinged pool ladders permit easy covering of the pool during the off season and also allow for easier cleaning of the pool. Nevertheless, these hinged pool ladders still interfere with the conduct of racing events and the ladders must be taken into consideration during the preparation for such events.

In addition, any means utilized for the quick detachment of a pool ladder from the pool deck must also incorporate a design which utilizes a minimum of exposed parts. Since such a device would be located at or near the pool deck surface, barefooted bathers would be prone to feet and toe injuries resulting from inadvertent collisions with any exposed parts.

It is, therefore, a primary object of the present invention to provide a securement means for a swimming pool ladder hingedly connected to the peripheral deck of a pool which permits quick and easy detachment of the ladder from the pool deck so that this peripheral area of the pool may be used for conducting swimming races and, furthermore, that such securement means presents no exteriorly located parts or elements.

This object, as well as others which will hereinafter become apparent, is accomplished in accordance with the present invention by providing a hinged pool ladder securement which includes means for quick and easy detachment and reattachment of the tubular rails of the pool ladder to the pool ladder securement. This quick detachment means comprises a ladder rail ferrule for each ladder rail hingedly connected to the anchor mounted in the pool deck and girdling the end of the tubular ladder rail, and means releasably securing the tubular ladder rail to the ladder rail ferrule. This releasable securement means includes an internally expandable locking member which expands against the inside wall of the ladder rail to lock thereagainst and which is coupled to the ladder rail ferrule to thereby lockingly engage the ladder rail to the ladder rail ferrule. To release this securement, it is only necessary to relax the pressure of the locking member against the inside wall of the ladder rail and thus disengage the ladder rail from the ladder rail ferrule.

Other objects and features of the present invention will become apparent from the following detailed description considered in connection with the accompanying drawings. It is to be understood, however, that the drawings are designed as an illustration only and not as a definition of the limits of the invention.

In the drawings wherein similar reference characters denote similar elements throughout the several views.

Figure 1:
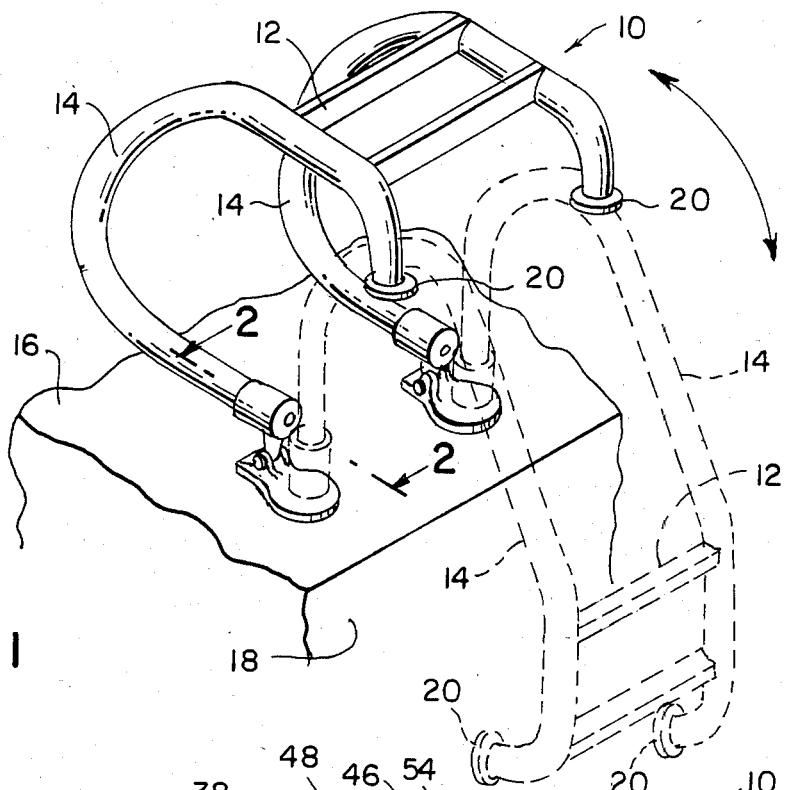
FIG. 1 is a perspective view of a swimming pool ladder secured to a pool deck in accordance with the present invention.

Now turning to the drawings, there is shown in FIG. 1, a swimming pool ladder, generally designated 10, having a plurality of rungs 12 interconnecting two identical tubular shaped ladder rails, designated 14. Ladder 10 is hingedly mounted to the horizontal surface of swimming pool deck 16 so that, when in the position shown in phantom in FIG. 1, rungs 12 form vertical steps to permit a bather in the pool to climb the ladder by mounting the rungs and grasping ladder rails 14 to lift himself out of the pool. At their upper ends, ladder rails 14 are provided with a reverse curve so that they meet the horizontal surface of pool deck 16 perpendicularly. The lower end of ladder rails 14 are turned inwardly toward the pool side wall, designaed 18, and are provided with bumpers 20 to abut the side wall.

Figure 2:
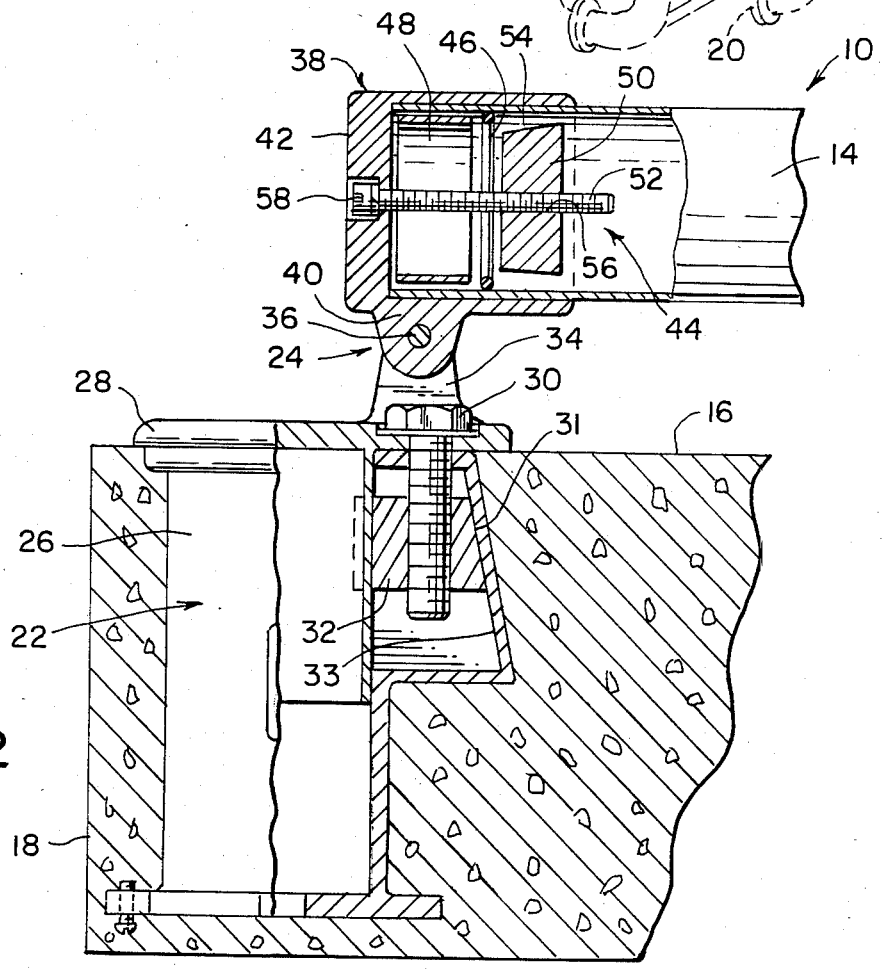
FIG. 2 is a cross-sectional view of the swimming pool ladder securement of FIG. 1 taken along the line 2—2 of FIG. 1.

As clearly seen in FIG. 2, pool ladder 10 is pivotally or hingedly mounted to an anchor assembly, designated 22, by means of hinge 24. Anchor assembly 22 is comprised of an anchor socket 26 having an escutcheon plate 28 fastened to the top thereof by means of bolt 30 and threaded wedge fastener 32. As bolt 30 is turned, thus drawing wedge fastener 32 upwardly, the wedge face 31 thereof engages the wedge face 33 of anchor socket 26 to lock thereagainst and thereby fasten escutcheon plate 28 to anchor socket 26. Anchor socket 26 is positioned in pool deck 16 at the time the concrete for the deck is poured so that it is thereby embedded within the deck. Extending from escutcheon plate 28 are bearing supports 34 which support hinge pin 36 of hinge 24.

Figure 4:
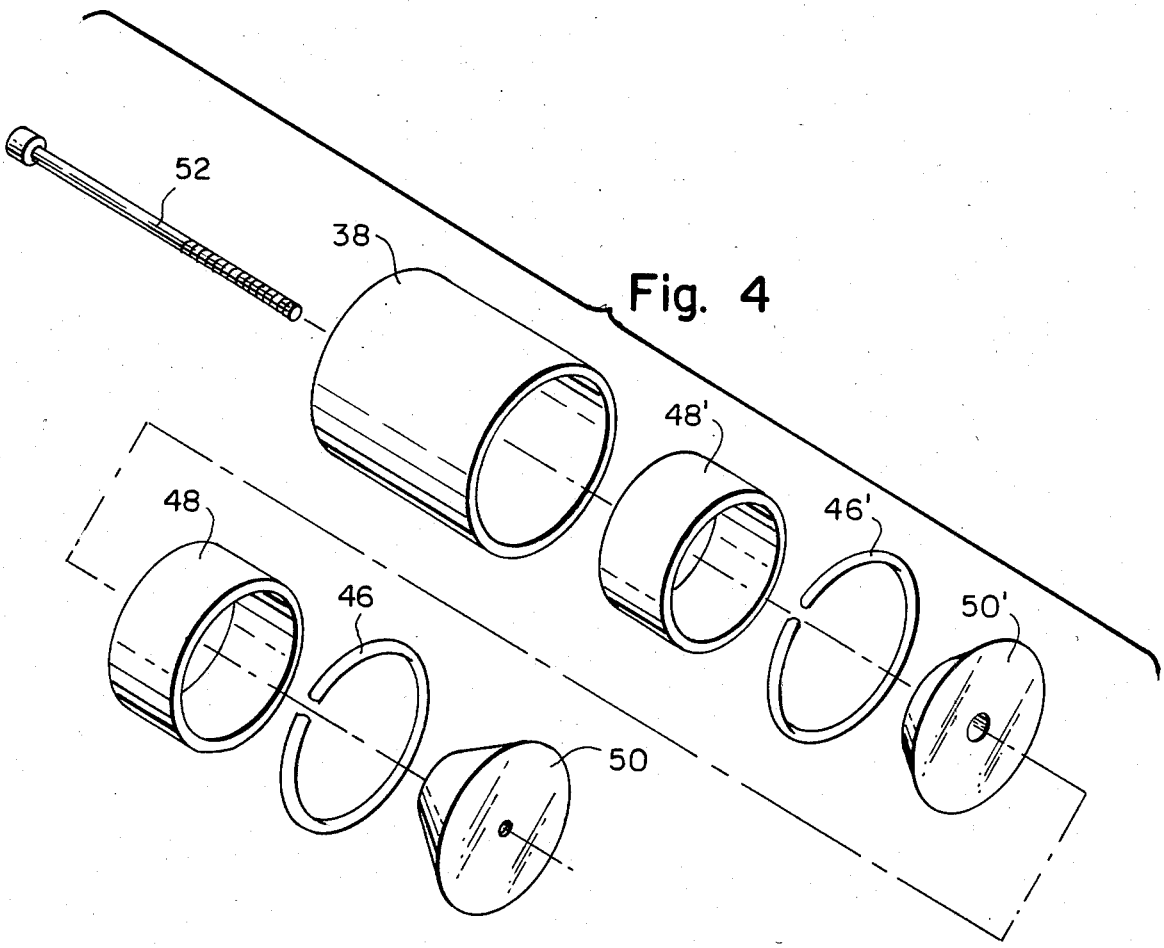
FIG. 4 is an exploded view of the securement means shown in FIG. 3.

Ladder rail 14 of ladder 10 is girdled at its end adjacent pool deck 16 by means of a ferrule, designated 38, which itself is provided with a bearing support 40 for hinge pin 36. Bearing support 40 of ferrule 38 is so positioned thereon to permit the flat end face 42 of ferrule 38 to be supported by and rest against escutcheon plate 28 when the ladder is positioned for use as shown in phantom in FIG. 1. Ladder rail 14 is releasably coupled with ferrule 38 by means of a clamping mechanism, designated 44, which includes an expandable lock ring 46, a spacer 48, a ring expander 50 and a clamping bolt 52. Expandable lock ring 46 is in the form of a split ring with a circular cross section (see FIG. 4) and is positioned on the interior of ladder rail 14 to lockingly engage against the inside wall thereof in a tangential circular point of contact manner, when expanded by ring expander 50. Ring expander 50 is wedge shaped in the form of a truncated cone whose tapered side wall 54 engages with ring 46. Bolt 52 engages a threaded opening 56 in ring expander 50 and the head 58 of bolt 52 engages the end 42 of ferrule 38 so that, as bolt 52 is turned, the threaded engagement with ring expander 50 causes the ring expander to be retracted towards end face 42 of ferrule 38. As a result of this movement, tapered side wall 54 of ring expander 50 engages wedge-like against lock ring 46 and, with the presence of spacer 48 to prevent ring 46 from being moved laterally along the inside of ladder rail 14 by ring expander 50, ring 46 is thereby caused to expand outwardly and lockingly engage with the inside wall of ladder rail 14. In this manner, ladder rail 14 is lockingly engaged with very high point of contact pressure to ferrule 38 so that no movement occurs therebetween. As can be appreciated, when it is desired to disengage ladder rail 14 from ferrule 38, it is a simple matter of merely unscrewing bolt 52 thereby relaxing the pressure exerted by ring expander 50 against lock ring 46 to thereby release the locking engagement between the lock ring and ladder rail 14 so that the ladder rail may be detached from ferrule 38. Thus, ladder 10 may be easily and quickly detached from its securement to pool deck 16 and removed.

Figure 3:
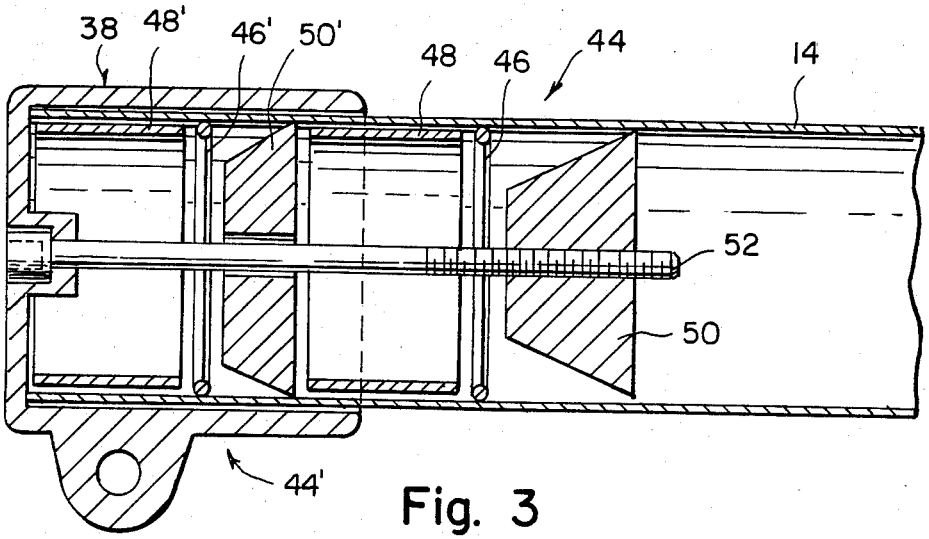
FIG. 3 is a cross-sectional view of a second embodiment of a portion of the swimming pool ladder securement similar to that shown in FIG. 2.

In FIG. 3 there is shown another embodiment of the engagement between ladder rail 14 and ferrule 38 which includes a double clamping mechanism similar in operation to the mechanism described above. In this double clamping mechanism there is included a clamping mechanism 44, essentially identical to that described above, arranged in tandem with an additional clamping mechanism 44'. Additional clamping mechanism 44' includes an expandable lock ring 46' identical to ring 46, spacer 48' identical to spacer 48 and ring expander 50' which is similar in operation to ring expander 50. Ring expander 50' has a central bore therein for the passage therethrough of clamping bolt 52 which is threadably engaged with ring expander 50. With the tandem arrangement shown in FIGS. 3 and 4, as clamping bolt 52 is turned thus moving ring expander 50 inwardly against lock ring 46 which in turn abuts against spacer 48, spacer 48 forces ring expander 50' inwardly against lock ring 46' and spacer 48'. In this manner, as clamping bolt 52 is further tightened, both expandable lock rings 46 and 46' are expanded to lockingly engage against the inner wall of ladder rail 14 to thereby provide a greater measure of clamping security between ladder rail 14 and ferrule 38. Again, in order to disengage ladder rail 14 from ferrule 38, it is a simple matter of merely unscrewing clamping bolt 52, thus releasing the outward expanding pressure against expandable lock rings 46 and 46' which are then relaxed, thereby permitting the detachment of ladder rail 14 from ferrule 38.

It is to be noted in connection with the securement devices described above that none of the component parts are located or positioned on the exterior of the pool ladder components. Therefore, there is no additional exposure to injuries by bathers in a pool where such quick detachable pool ladders are utilized.

While only two embodiments of the present invention have been shown and described, it will be obvious that many changes and modifications may be made thereunto without departing from the spirit and scope of the present invention.

What is claimed is:

1. A releasable securement device for a swimming pool ladder having a tubular ladder rail hingedly connected to an anchor mounted in the swimming pool deck, comprising:

a hollow cup-like cylindrical ferrule having an open end and a generally closed end, said ferrule conformed to slidably and coaxially receive the tubular ladder rail through the open end of the said ferrule, the closed end having a hole therethrough located approximately coaxially to the longitudinal axis of said ferrule;

means for hingedly attaching said ferrule to the anchor;

clamping bolt means passing through said hole in the closed end of said ferrule and disposed generally coaxially with the longitudinal axis of said ferrule;

a conically-shaped ring expander having a tapered side wall, and threadably engaged to said clamping bolt means, said expander being coaxially positioned within the tubular ladder rail to be secured, said tapered side wall facing the closed end of said ferrule, said expander having a diameter slightly smaller than the inside diameter of the tubular ladder rail;

a toroidal split ring having a round cross section and being disposed within the ladder rail and engaging the tapered side wall of said expander;

a hollow cylindrical spacer having an outside diameter slightly smaller than the inside diameter of the ladder rail, said spacer being positioned within the ladder rail, between said ring and the closed end of said ferrule, so that when said bolt means is tightened, said expander retracts towards the closed end of said ferrule, forcing the tapered sidewall of said expander to expand said ring radially outward to lockingly engage the inner surface of the rail in a tangential, circular manner, said spacer preventing said ring from moving laterally within the rail.

2. The securement device as defined in claim 1, wherein said means for hingedly attaching said ferrule to the anchor comprises;

an escutcheon plate;

at least two spaced apart plate bearing supports attached to said plate;

a ferrule bearing support connected to said ferrule and disposed between said plate bearing supports;

a hinge pin pivotally coupling said plate bearing supports to said ferrule bearing support; and an anchor bolt disposed between said plate bearing supports, said bolt passing through said plate and threadably engaging the anchor, thereby clamping said plate onto the anchor, said plate bearing supports and said ferrule bearing support therein preventing useful access to said bolt after said hinge pin is installed, thereby making a tamper-resistant attachment.

3. The securement device as defined in claim 1, wherein said hole in the closed end of said ferrule is counterbored, thereby preventing said clamping bolt from protruding beyond the bottom end of said ferrule.

4. A releasable securement device for a swimming pool ladder having a tubular ladder rail hingedly connected to an anchor mounted in the swimming pool deck, comprising:

a hollow cup-like cylindrical ferrule having an open end and a closed end, said ferrule conformed to slidably and coaxially receive a tubular ladder rail through its open end, the closed end having a hole therethrough located approximately coaxially to the longitudinal axis of said ferrule;

means for hingedly attaching said ferrule to the anchor;

clamping bolt means passing through said hole in the closed end of said ferrule and disposed generally coaxially with the longitudinal axis of said ferrule;

a first conically-shaped ring expander having a tapered side wall, and threadably engaged to said clamping bolt means, said expander being coaxially positioned within the tubular ladder rail to be secured, said tapered side wall of said first expander facing the closed end of said ferrule, said first expander having a diameter slightly smaller than the inside diameter of the tubular ladder rail;

a first toroidal split ring having a round cross section, and being disposed within the ladder rail and engaging the tapered side wall of said first expander;

a hollow cylindrical first spacer having an outside diameter slightly smaller than the inside diameter of the ladder rail, said first spacer being positioned within the ladder rail, for engagement with said first ring;

a second conically-shaped ring expander having a tapered side wall, said second expander being coaxially positioned within the tubular ladder rail to be secured, the tapered side wall of said second expander facing the closed end of said ferrule, said expander having a diameter slightly smaller than the inside diameter of the tubular ladder rail, said clamping bolt means slidably passing through said second expander;

a second toroidal split ring having a round cross section, and being disposed within the ladder rail and engaging the tapered side wall of said second expander; and a hollow cylindrical second spacer having an outside diameter slightly smaller than the inside diameter of the ladder rail, said second spacer being positioned within the ladder rail between said second ring and the closed end of said ferrule, so that when said bolt means is tightened, said first expander retracts toward the closed end of said ferrule, forcing the tapered side wall of said first expander to expand said first ring radially outward, said first spacer being forced by said first expander, in turn, forcing said second expander towards the bottom end of said ferrule, thereby forcing the tapered side wall of said second expander to expand said second ring radially outward, said second spacer preventing said second ring from moving laterally within the rail, said first ring and said second ring therein lockingly engaged the inner surface of the rail, in a tangential, circular manner.

* * * * *